United States Patent [19]

Edge

[11] Patent Number: 4,754,507

[45] Date of Patent: Jul. 5, 1988

[54] BACK REST DEVICE

[76] Inventor: Norman J. Edge, 60 High Street, Huntingdon, Huntingdonshire, England

[21] Appl. No.: 7,644

[22] Filed: Jan. 28, 1987

[51] Int. Cl.[4] ..... A47C 20/04

[52] U.S. Cl. ..... 5/72; 5/433

[58] Field of Search ..... 5/72, 73, 432, 433; 297/343

[56] References Cited

U.S. PATENT DOCUMENTS

| | | | |
|---|---|---|---|
| 508,382 | 11/1893 | Goodliffe | 5/73 |
| 2,666,213 | 1/1954 | Bash | 5/73 X |
| 2,666,216 | 1/1959 | Schnaitter | 5/433 |
| 3,217,341 | 11/1965 | Levy | 5/433 |
| 3,287,746 | 11/1966 | Weddle | 5/433 |
| 4,185,342 | 1/1980 | Young | 5/433 |

FOREIGN PATENT DOCUMENTS

| | | |
|---|---|---|
| 330400 | 6/1930 | United Kingdom . |
| 511866 | 8/1939 | United Kingdom . |
| 879720 | 10/1961 | United Kingdom . |
| 1137645 | 12/1968 | United Kingdom . |
| 2057256 | 4/1981 | United Kingdom . |
| 2108834 | 5/1983 | United Kingdom . |
| 2169501 | 7/1986 | United Kingdom . |
| 2171297 | 8/1986 | United Kingdom . |
| 2183469 | 6/1987 | United Kingdom . |

*Primary Examiner*—Michael F. Trettel

*Attorney, Agent, or Firm*—Roylance, Abrams, Berdo & Goodman

[57] ABSTRACT

A back rest device comprising frame means, a back rest, and connecting means for pivotally connecting the back rest to the frame means such that the back rest is pivotable in use of the back rest device between a substantially vertical position and an inclined position, and the connecting means also being such that the back rest is movable up and/or down as it is pivoting between the substantially vertical position and the inclined position whereby the back rest is able to rise over any obstacles that may be in the way.

7 Claims, 5 Drawing Sheets

BACK REST DEVICE

This invention relates to a back rest device.

There are many situations in the home in which it would be an advantage to have a back rest device. Especially in bedrooms, persons reading, watching television or merely lying often require to support their backs so that they are comfortable. In addition, some persons sitting in chairs find the need for a back rest device.

It is an aim of the present invention to provide a back rest device which can be used in the home and wherever else desired, which back rest device is especially easy to operate for the convenience of the user and which back rest device is also able to move between a substantially vertical position and a desired inclined position.

Accordingly, this invention provides a back rest device comprising frame means, a back rest, and connecting means for pivotally connecting the back rest to the frame means such that the back rest is pivotable in use of the back rest device between a substantially vertical position and an inclined position, the connecting means also being such that the back rest is movable up and/or down as it is pivoting between the substantially vertical position and the inclined position whereby the back rest is able to rise over any obstacles that may be in the way, the connecting means comprising a bracket and a roller arrangement which is mounted to the bracket, and the bracket comprising a first part for supporting the roller arrangement, a second part which is secured to the frame means, and a pivot member which is connected to the first part.

Because the back rest is able to move up and/or down at the same time as it is pivoting between the substantially vertical position and the inclined position, the back rest can very easily be gripped by a user merely extending their hand backwards and it can be easily pulled forward to the inclined position or pushed backwards to the substantially vertical position whilst at the same time rising in response to slight lifting pressure to rise over obstacles such for example as bedclothes, books, newspapers and the like.

The frame means may be a support post. Alternatively, the frame means may be two or more support posts. Alternatively, the frame means may be a support tunnel. Generally, the frame means may be of any desired construction that enables the back rest to be stably mounted and to pivot as mentioned above. The frame means may be of any size and the actual size of the frame means will depend upon where the back rest device is being used, for example on a bed or on a chair.

The back rest may be in the form of a headboard if the back rest device is to be used on a bed. The headboard may look exactly the same as existing headboards from the front so that it may be padded and designed as may be required.

The back rest may form the back of a chair, or it may look like the back of a chair, if the back rest device is to be used on a chair.

The back rest device can be manufactured and sold on its own as a device for fitting to existing articles of furniture such for example as beds and chairs. In this case, the back rest device can be made to clip, screw, bolt or slide in position.

Usually, the back rest device will be manufactured such that it forms an integral part of the article of furniture during the manufacture of the article of furniture.

Since the back rest device can be made when the remainder of the article of furniture is being manufactured, the back rest device should not add substantially to the overall cost of the article of furniture, and the back rest device will afford the advantage of enabling a person always to have the facility of a back rest which can be moved between the substantially vertical position and a desired horizontal position.

The back rest can generally be inclined to any desired angle since the lower edge of the back rest can rest on the mattress of a bed, the seat of a chair or any other desired surface at any desired position to give the required angle of inclination.

The roller arrangement may comprise a pair of rollers.

The roller arrangement may comprise first, second and third rollers, the first and the second rollers being spaced apart from the third roller so that an elongate member slides between the first and the second rollers on the one hand and the third roller on the other hand, the first and the second rollers being positioned nearest to the back rest.

Preferably, the elongate member is a bar.

The pivot member will usually be a pivot pin or a pivot bolt.

The back rest device of the invention may include a guide device for helping to guide the back rest as it is moved between the substantially vertical position and the inclined position.

The guide device may be provided at each of its ends with first and second pivotable mounting means, the first pivotable mounting means being secured to the frame means, and the second pivotable mounting means being secured to the back rest.

The second pivotable mounting means may be secured directly to the back rest, or it may be indirectly secured to an intermediate member, for example a strengthening strut.

The guide device may be a piston and cylinder device. Alternatively, the guide device may be a folding arm. Other types of guide devices may be employed.

The back rest device may be such that it has one guide device. Alternatively, the back rest device may be such that it has more than one guide device, for example two guide devices.

The back rest device may include stop means for ensuring that an article of furniture to which the back rest device is attached is spaced at a predetermined distance from a wall or the like.

The stop means may be a simple stop or, if desired, the stop means may be a bracket which is securable to the wall.

The back rest device may include retaining means for retaining the back rest device in its folded position with the back rest in the substantially vertical position.

As mentioned above, the construction of the frame can vary as appropriate for the particular article of furniture to which the back support device is attached or forms a part. With a single bed, the frame means may be two posts such as the two posts that are usually used on known headboards. With single beds, two guide means will usually be employed to ensure that both sides of the headboard move together.

For a double bed, the above described construction for a single bed may be employed but obviously larger to extend the width of the double bed. Alternatively, the double bed could have two single units, thereby affording both users of the double bed the freedom of choice as to when to have their back rest in an inclined position or in the vertical position. In this arrangement, two separate frame means will usually be employed, one for each back rest device.

The present invention also extends to an article of furniture when provided with the back rest device.

The article of furniture will usually be a bed or a chair but it may be another type of article of furniture if desired. Although the article of furniture will usually be used in the home, it can also be an article of furniture for use in offices, factories and other establishments.

Embodiments of the invention will now be described solely by way of example and with reference to the accompanying drawings in which.

Figure 1:
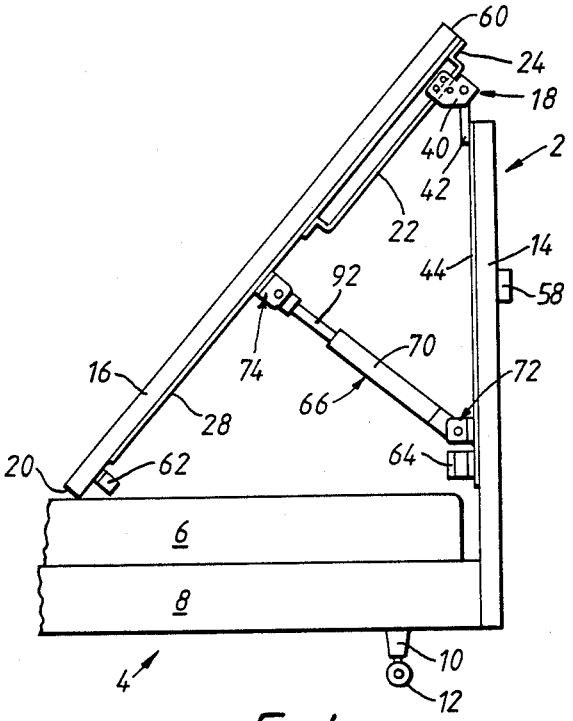
FIG. 1 is a side view of a first back rest device in an inclined position.

Referring to FIGS. 1 to 3C, there is shown a back rest device 2 in position on a bed 4, the bed 4 comprising a mattress 6 and a divan 8. The divan 8 has legs 10 having castors 12. The back rest device 2 comprises frame means in the form of a post 14 which is secured to the divan 8 by a screw bolt in the same manner as currently employed for existing headboards.

Figure 2:
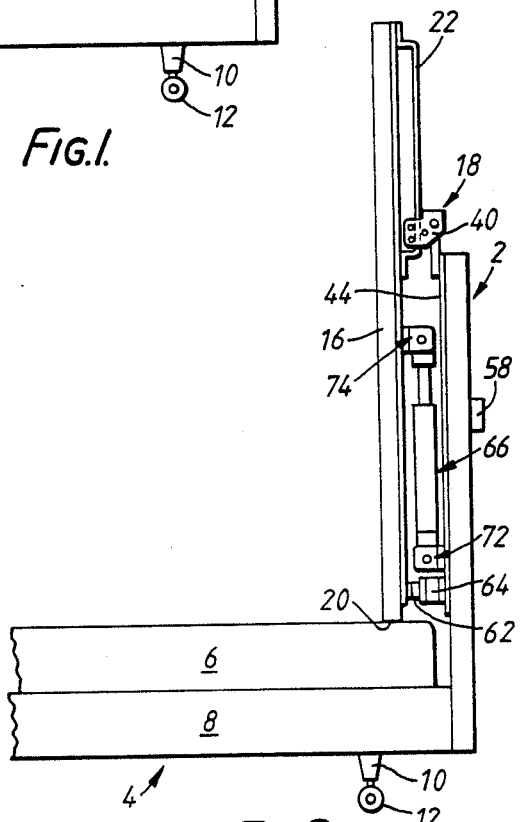
FIG. 2 shows the back rest device of FIG. 1 in a folded position in which the back rest is vertical.

The back rest device 2 further comprises a back rest 16 which is actually formed as a headboard. Connecting means 18 pivotally connect the back rest 16 to the post 14. The connection is such that the back rest 16 is pivotable in use of the back rest device 2 between a substantially vertical position as shown in FIG. 2 and a desired inclined position as shown in FIG. 1. Any desired inclined position of the back rest 16 may be achieved because the lowermost end 20 of the back rest 16 merely presses on to the top of the mattress 6. In the folded position of the back rest device 2, the lowermost end 20 of the back rest 16 may rest on top of the mattress 6 as shown in FIG. 2 or, alternatively, the mattress 6 may be moved forwards slightly in which case the back rest 16 may drop down behind the mattress 6.

The connecting means 18 is also such that the back rest 16 is movable up and/or down as it is pivoting between the substantially vertical position and the inclined position, whereby the back rest 16 is able to rise over any obstacles (not shown) that may be in the way on top of the mattress 6. Such obstacles may be, for example, books, newspapers or pillows.

Figure 3A:
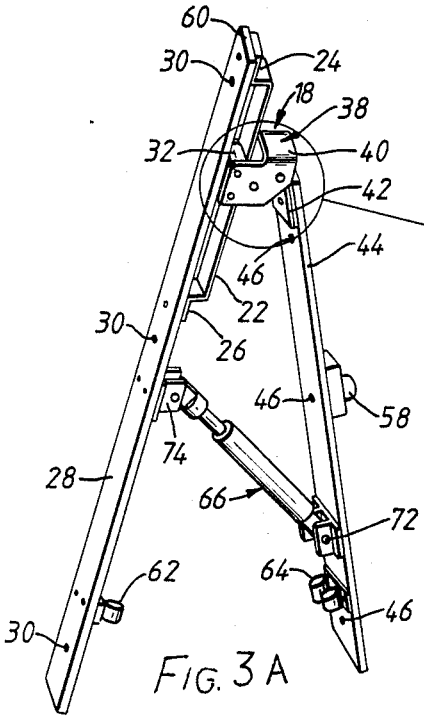
FIG. 3A is a perspective view of the back rest device as shown in FIG. 1.
Figure 3B:
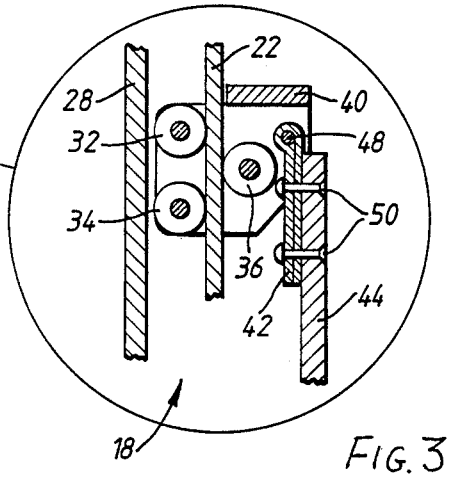
FIG. 3B shows in enlarged form connecting means which forms a part of the back rest device as shown in FIG. 3A.
Figure 3C:
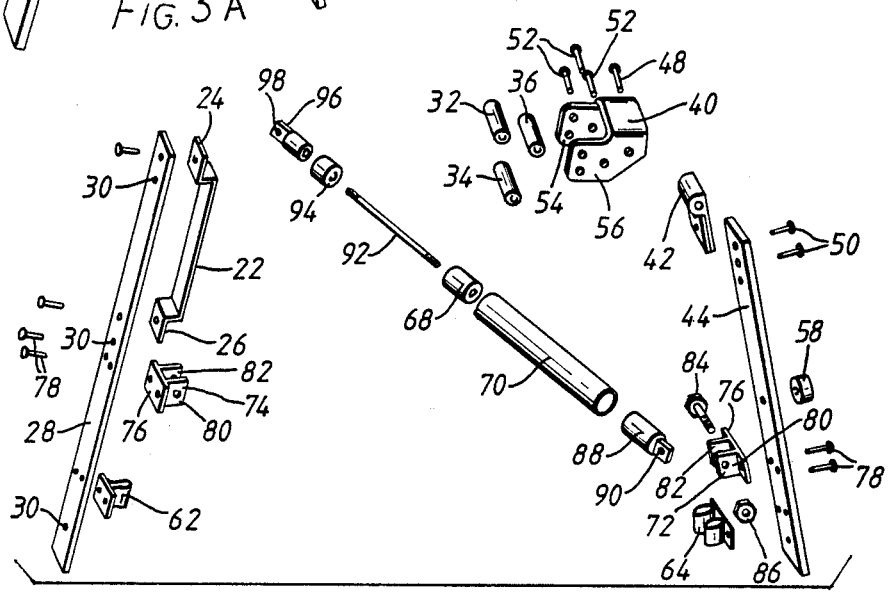
FIG. 3C shows in expolded form various parts of the back rest device as shown in FIG. 3A.

Referring especially to FIGS. 3A, 3B and 3C, it will be seen that the connecting means 18 comprises an elongate member in the form of a bar 22 which is screwed at its cranked ends 24,26 to a strut 28. The strut 28 is provided with three attachment holes 30 which enable the back rest 16 to be bolted to the strut 28.

The connecting means 18 also comprises a roller arrangement having first, second and third rollers 32,34,36. The first and the second rollers 32,34 respectively are spaced apart from the third roller 36 so that the bar 22 is able to slide between the first and the second rollers 32,34 on the one hand and the third roller 36 on the other hand. It will be seen that the first and the second rollers 32,34 are positioned nearest to the back rest 16.

The rollers 32,34,36 are mounted in a bracket 38 which is pivotable with respect to the post 14. The bracket 38 comprises a first part 40 for supporting the roller arrangement, and a second part 42 which is secured to the frame means. More specifically, the second part 42 is secured to a strut 44 which is provided with three attachment holes 46 for enabling the strut 44 to be bolted to the post 14. The first part 40 and the second part 42 of the bracket 38 are pivotally connected together by a pivot member in the form of a pivot pin 48. The second part 42 is connected to the strut 44 by rivets 50.

The rollers 32,34,36 are nylon rollers and they rotate on pins 52 which are supported between ears 54,56 of the first part 40.

The strut 44 is provided with a wall stop 58 for preventing a bed to which the back rest device 2 forms a part getting too close to the wall and being scraped by the top end 60 of the back rest 16, or the top end 60 of the strut 28 or the end 24 of the bar 22. It will be apparent that the ends may extend backwardly beyond the post 14 as the back rest 16 is lifted up and then pivoted from the position shown in FIG. 2 to the position shown in FIG. 1.

The strut 28 is provided with a first clip part 62 and the strut 44 is provided with a complementary second clip part 64. These two clip parts 62,64 come together as shown in FIG. 2 to constitute retaining means for retaining the back rest device 2 in its folded position with the back rest 16 in the substantially vertical position.

The back rest device 2 includes a guide device 66 for helping to guide the back rest 16 as it is moved between the vertical position shown in FIG. 2 and the inclined position shown in FIG. 1. The guide device 66 is a piston and cylinder arrangement having a piston 68 operating inside a cylinder 70. The guide device 66 is provided at each of its ends with first and second pivotable mounting means 72,74. As shown, the first pivotable mounting means 72 is secured to the post 14 via the strut 44, and the second pivotable mounting means 74 is secured to the back rest 16 via the strut 28. As shown most clearly in FIG. 3A, the first and second pivotable mounting means 72,74 each have a back plate portion 76 which is secured to the struts 28 and 44 by means of rivets 78 as shown. Extending from the back plate portion 76 are a pair of ears 80,82 and these ears 80,82 are apertured to receive a bolt 84 which is held in position by a nut 86, the bolt 84 then acting as a pivot bolt. The end of the cylinder 70 terminates in a swaged swivel 88 which has an aperture 90 through which the bolt 84 passes. The piston 68 is screwed to a piston rod 92 and this piston rod 92 passes through a piston rod bush 94 which is itself connected to a swivel 96. The swivel 96 is provided with an aperture 98 through which the other bolt 84 (not shown in FIG. 3C) passes when it passes between the apertures in the ears 80,82 of the second pivotable mounting means 74.

The guide device 66, although shown as a piston and cylinder device, does not really assist in moving the back rest 16 outwardly in the sense of providing positive force. The guide device 66 is merely desirable to help guide the back rest 16 and, the back rest 16 will usually have one of the guide devices 66 at each of its ends to ensure that both ends of the back rest 16 move out simultaneously.

Figure 4A:
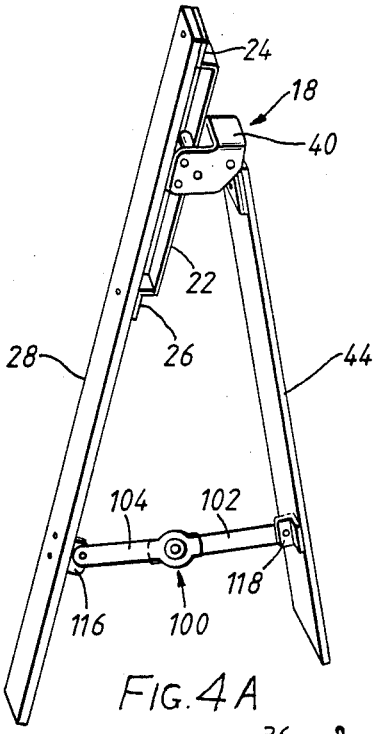
FIG. 4A is a perspective view of a second back rest device.
Figure 4B:
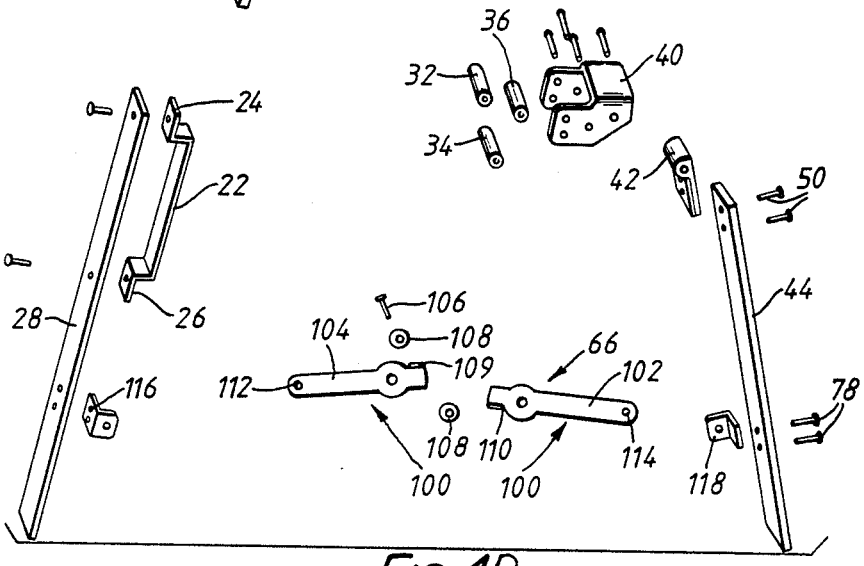
FIG. 4B shows in exploded form various parts of back rest device as shown in FIG. 4A.

Referring now to FIGS. 4A and 4B, similar parts as in FIGS. 3A, 3B and 3C have been given the same reference numerals and their precise construction and operation will not again be given. FIGS. 4A and 4B differ mainly from FIGS. 3A, 3B and 3C in the respect the FIGS. 4A and 4B employ a different guide device 66. In FIGS. 4A and 4B, the guide device 66 is a folding arm 100. The folding arm 100 has two portions 102,104 which are pivotally connected together at their centres by a rivet 106 and a pair of compression washers 108. The portions 102,104 have overlapping flanges 109,110 which mate together to hold the entire foldable arm 100 in its straight position as also shown in FIGS. 4A and 4B. The ends of the arm portions remote from the flanges 109, 110 are provided with apertures 112,114 for fitting to swivel brackets 116,118 respectively. The swivel bracket 116 fits to the strut 28 and the swivel bracket 118 fits to the strut 44.

Figure 5:
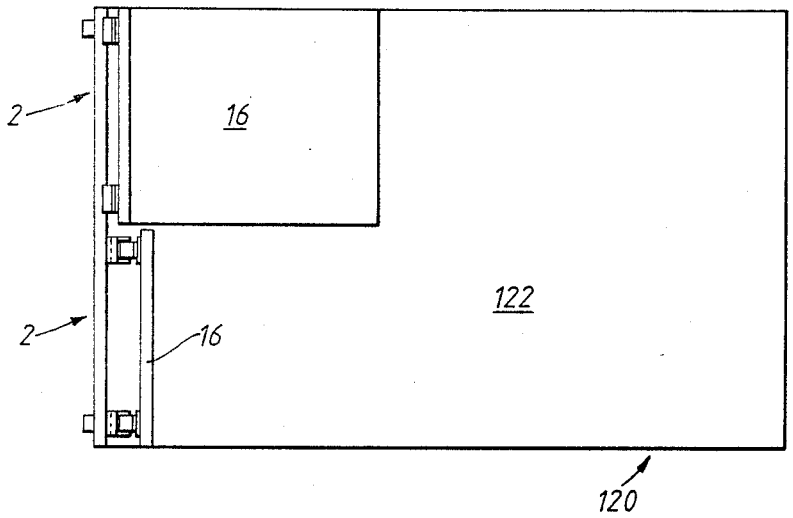
FIG. 5 is a plan view of a double bed showing two of the back rest devices illustrated in FIGS. 1 to 3 in position, with one of the back rest devices being folded so that the back rest is in a vertical position and with the other back rest being in an inclined position.
Figure 6:
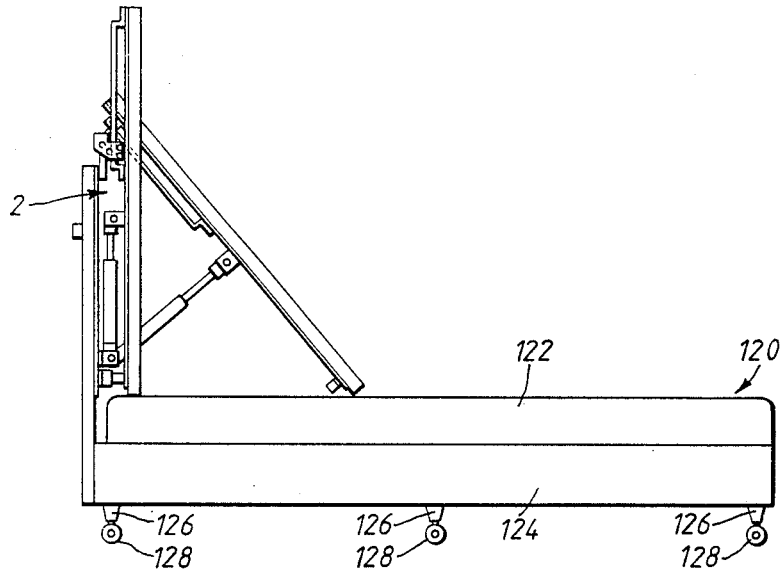
FIG. 6 is a side view of the double bed shown in FIG. 5.

Referring now to FIGS. 5 and 6, there are shown two back rest devices 2 on a double bed 120. The double bed 120 has a mattress 122 and a divan 124. The divan 124 is provided with legs 126 which have castors 128. It will be appreciated that, because the bed 120 has two of the back rest devices 2, then the individual users of the bed 120 can choose individually whether or not to support their back, this being illustrated most clearly in FIG. 5 which shows the topmost back rest 16 in its inclined position and the bottom-most back rest 16 in its vertical position.

Figure 7A:
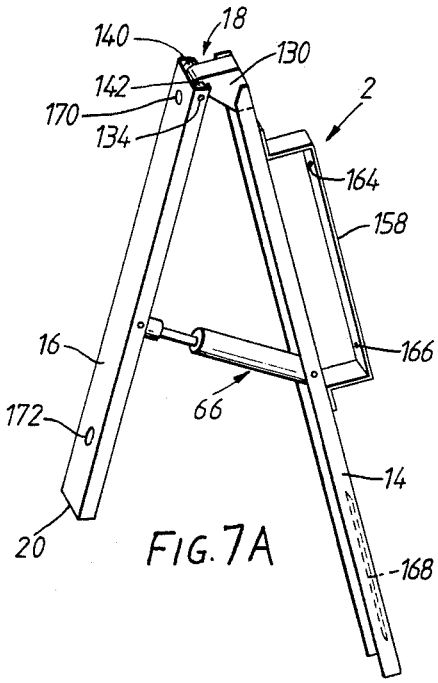
FIG. 7A is a perspective view of a third back rest device.
Figure 7B:
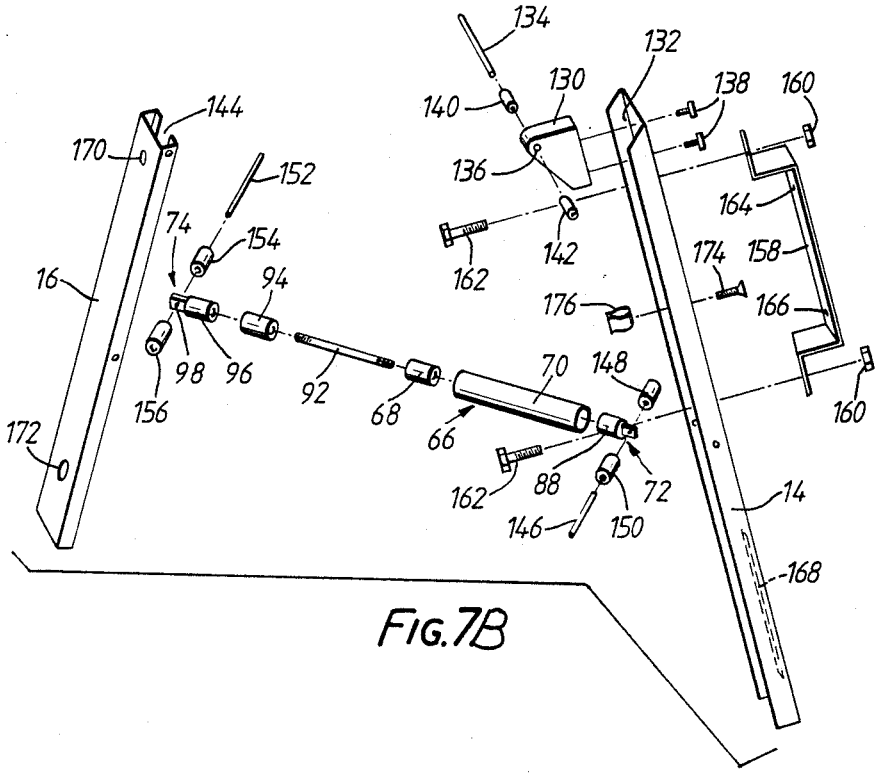
FIG. 7B shows in exploded form various parts of the back rest device shown in FIG. 7A.

Referring now to FIGS. 7A and 7B, similar parts as in FIGS. 3A, 3B and 3C have been given the same reference numerals and their precise construction and operation will not again be given. In FIGS. 7A and 7B, the connecting means 18 is different from that shown in FIGS. 3A, 3B and 3C and, in particular, the bar 22 and the roller arrangement of the first, second and third rollers 32, 34, 36 are not employed. In FIGS. 7A and 7B, the connecting means 18 comprises a bracket 130 which locates in a channel 132 in the post 14. The bracket 130 is held in position in the channel 132 by means of a pair of self-tapping screws 138. A pin 134 passes through apertures 136 and supports a pair of rollers 140, 142. In the assembled condition, the rollers 140, 142 locate in a channel 144 in the back rest 16.

As can be seen from a comparison of FIGS. 3A, 3B and 3C, and 7A and 7B, the guide device 66 in FIGS. 7A and 7B is slightly different from that shown in FIG. 3A. In FIGS. 7A and 7B, a pin 146 is used to mount two rollers 148, 150 in the channel 132 of the post 14. Another pin 152 is used to mount a pair of rollers 154, 156 in the channel 144 of the back rest 16. The rollers 148, 150 and 154, 156 give simple and easy pivotal movement.

In FIGS. 7A and 7B, the post 14 is provided with a bracket 158 which enables the post 14 to be fixed to a wall if desired. Wall fixings may be passed through apertures 164, 166 in the bracket 158. The post 14 is provided with an elongate slot at its bottom end, the slot being shown somewhat schematically in dotted lines as slot 168. The slot 168 enables the post 14 to be fixed to a divan at the usual place where a known headboard would be fitted. The slot 168 enables vertical adjustment. Apertures 170, 172 enable the back rest 16 to be secured to a headboard.

A rivet 174 mounts a clip 176 for use in keeping the guide device 66 in a closed position.

It is to be appreciated that the embodiments of the invention described above with reference to the accompanying drawings have been given by way of example only and that modifications may be effected. Thus, for example, a single back rest device 2 could be employed across the entire double bed 120, or one of the back rest devices 2 could be employed on a single bed. Instead of employing the back rest devices 2 on beds, they may be employed on chairs or other articles of furniture and the frame means will be appropriately sized, constructed and designed to suit the particular article of furniture. Usually the back rest devices 2 will be formed as part of the articles of furniture during the manufacture of the articles of furniture but, if desired, the back rest devices 2 can be produced as add-on units to existing articles of furniture such for example as beds and chairs.

I claim:

1. A back rest device, comprising: frame means, a back rest, and connecting means for pivotally connecting the back rest to the frame means such that the back rest is pivotable in use of the back rest device between a substantially vertical position and an inclined position, the connecting means also being such that the back rest is movable up and/or down as it is pivoting between the substantially vertical position and the inclined position whereby the back rest is able to rise over any obstacle that may be in the way, the connecting means comprising a bracket and a roller arrangement which is mounted to the bracket, and the bracket comprising a first part for supporting the roller arrangement, a second part which is secured to the frame means, and a pivot member which is connected to the first part.

2. A back rest device according to claim 1 in which the frame means is at least one support post.

3. A back rest device according to claim 1 and including a guide device for helping to guide the back rest as it is moved between the substantially vertical position and the inclined position.

4. A back rest device according to claim 3 and including stop means for ensuring that an article of furniture to which the back rest device is attached is disposed at a predetermined distance from a wall.

5. A back rest device according to claim 4 and including retaining means for retaining the back rest device in its folded position with the back rest in the substantially vertical position.

6. A back rest device according to claim 3 in which the guide device has a pair of ends, and in which the guide device is provided at each of its said ends with first and second pivotable mounting means, the first pivotable mounting means being secured to the frame means, and the second pivotable mounting means being secured to the back rest.

7. A back rest device according to claim 6 in which the guide device is a piston and cylinder device.

* * * * *